US008752858B2

(12) United States Patent
Bennert

(10) Patent No.: US 8,752,858 B2
(45) Date of Patent: Jun. 17, 2014

(54) SKI, BOOT AND BINDING BETWEEN A SKI AND A BOOT

(71) Applicant: ONE WAY Sport OY, Vantaa (FI)

(72) Inventor: Adreas Bennert, Vantaa (FI)

(73) Assignee: One Way Sport Oy, Vantaa (FI)

( * ) Notice: Subject to any disclaimer, the term of this patent is extended or adjusted under 35 U.S.C. 154(b) by 0 days.

(21) Appl. No.: 13/932,266

(22) Filed: Jul. 1, 2013

(65) Prior Publication Data

US 2014/0001733 A1 Jan. 2, 2014

(30) Foreign Application Priority Data

Jul. 2, 2012 (FI) ..... 20125765
Feb. 28, 2013 (EP) ..... 13157272

(51) Int. Cl.
*A63C 9/00* (2012.01)

(52) U.S. Cl.
USPC ..... 280/613

(58) Field of Classification Search
USPC ..... 280/611–627
See application file for complete search history.

(56) References Cited

U.S. PATENT DOCUMENTS 4,796,908 A * 1/1989 Makarenko ..... 280/615
5,664,797 A * 9/1997 Haughlin ..... 280/615
2007/0138765 A1 6/2007 Miette et al.
2014/0001733 A1* 1/2014 Bennert ..... 280/613

FOREIGN PATENT DOCUMENTS

EP 0 725 578 11/1997

* cited by examiner

*Primary Examiner* — John Walters
*Assistant Examiner* — James Triggs
(74) *Attorney, Agent, or Firm* — Young & Thompson

(57) ABSTRACT

A binding (1) for disengagebly fixing a boot (20) into a cross-country ski (10), where the boot has a sole (22) with an outer surface (23) adapted to positioning towards a top surface (13) of the ski. The binding has a cleat (30) including a flange (31) at a lock distance (S1) from the outer surface of the sole, and a base (24) extending from the flange, whereupon the base has a smaller base cross-section (A2) than a flange cross-section (A1) of the flange. The binding further includes a single frame plate (9) having a frame opening (14) with an opening cross-section (A3) larger than the base cross-section (A2) and larger than the flange cross-section (A1); and a lever (8) or a slide (7) movable in directions (P1 or P2) parallel to the top surface (13) of the ski. The lever/slide is between the outer surface and the flange.

15 Claims, 6 Drawing Sheets

SKI, BOOT AND BINDING BETWEEN A SKI AND A BOOT

FIELD OF THE INVENTION

The invention relates a binding disengagebly fixing a boot or a shoe into a ski: Said ski having a length direction, sides with a width therebetween and a thickness perpendicular to said length and width, as well as a top surface extending in directions of said length and width; Said boot/shoe having a foot covering section and a sole with a boot length direction and an outer surface adapted to positioning towards said top surface of the ski; Whereupon said binding has: rigid connection elements attached to said sole, as well as stationary locking elements receiving said connection elements, and movable locking elements disengagebly fastening said rigid connection elements in the boot against said stationary locking elements, both said elements attached to said ski. The invention further relates both bindings for skating style cross country skiing and bindings for classic style cross country skiing The invention may also be applied in bindings for ski jumping.

BACKGROUND OF THE INVENTION

During the last decades, several types of bindings for cross-country skiing have been suggested and published. However, many of those bindings have not been used for various reasons. One reason for problems is that the skiing boots/shoes and the bindings in the skies shall be matched by construction type with each other, meaning that the boot manufacturing company, the binding manufacturing company, and the ski manufacturing company must have close cooperation. Another problem is that the users may want to buy new boots for their old skis, or new skis for their old boots. This means that the new binding models should work with boots and skis of older models. This, on the other hand, brings the problem of accumulated features that are necessary in boots, skis and bindings in order to ensure compatibility with older models.

Most prior art bindings use a connection at the very front end of the boot. This solution does not allow optimally ergonomic movement of the users foot. The front connection does not either provide user's accurate control of the ski. Additionally, there have been other technical problems and/or lack in ease of use in the prior art bindings.

Prior art document US 2007/0138765 A1 discloses a cross-country ski binding device that retains the front end of a cross-country ski boot, the rear end of the boot remaining free to be raised and lowered. For this purpose the ski assembly comprises: a ski having an upper surface adapted to receive a binding device to retain a boot on the ski; a binding device to retain at least a front end of a boot against detachment from the ski, said binding device comprising an anchoring device for anchoring the binding device to the ski, said anchoring device comprising a slide, and a tightening mechanism for enabling a flattening of a lower part of the binding device against the upper surface of the ski.

In the binding device of the document the front connector is adapted to cooperate with a locking mechanism having a movable hook-shaped jaw and a transverse edge forming all immovable jaw for locking the boot onto the sports apparatus, or ski. Once locked in the locking mechanism, the front connector can freely pivot inside the jaw, thus allowing for an articulated binding of the front end of the boot. In this mentioned document the binding device is adapted to ensure the binding of a cross-country ski boot having two-part connectors, whereupon the boots has two connectors, such as rods or pins or other structural elements, arranged in the boot sole so as to be flush beneath the latter, or substantially flush. Therefore, these connectors are, for example, two cylindrical connectors extending across a longitudinal groove provided in the lower surface of the sole of the boot. The front connector is arranged, for example, in the vicinity of the front end of the sole, and the rear connector is rearwardly offset by a predetermined distance, so as to be arranged in the area of, or forward of, a zone of the boot corresponding to the metatarsophalangeal zone of the user's foot. The arrangement of the connecting zones enables the skier, when using a boot having a flexible sole, to maintain a flexing of the boot that corresponds to the flexing of the foot.

Document EP 0 725 578 B1 discloses a cross-country ski shoe/boot consisting of an upper joined to a sole and of which the sole has a means of fixing and hinging to the upper surface of the waist of a ski, this means being located close to the front end of the sole, whereupon the lower surface of the sole also has a second means of fixing located in the area between the heel and the metatarsal-phalangeal joint capable of co-operating with a matching means of fixing located on the upper surface of the waist of the ski. Further the first means of fixing consists of a shaft that is transversal with respect to the longitudinal direction of the ski, and the second means of fixing consists of a transverse shaft that is parallel to shaft and located in the same longitudinal direction of the shoe, each means of fixing being accommodated in a separate recess made in the outer surface of sole.

The document also discloses a cross-country ski unit using the mentioned shoe, the ski unit comprising a ski and a binding which may or may not be integral with the ski. This binding comprises: device suitable for cooperating with and retaining the first means of fixing of the shoe and capable of sliding in a direction that is parallel to the longitudinal direction of the ski, and a means of control placed in front of the binding intended to make said device slide in order to engage it in or release it from the first means of fixing of the shoe; whereupon the binding has a second device intended to cooperate with and retain the second means of fixing on the sole of the shoe located between the area of the heel and the metatarsal-phalangeal joint.

Although the solutions disclosed in these prior art documents reduce effects of some of the problems described above, the solutions are still not optimal. For example, the distance between the user's foot and the ski bottom is too high in order to allow accurate control of the ski. Also, the described solutions are not optimized for both skating type skiing and classic type skiing

SUMMARY OF THE INVENTION

It is an object of the invention to provide a binding solution wherein the problems of the prior art are avoided or reduced.

In the inventive binding and boot the rigid connection elements are a cleat comprising a flange at a lock distance from the outer surface of the sole, and a base extending from said flange against said outer surface of the sole, whereupon said base has a smaller base cross-section than a flange cross-section of said flange. Further said stationary locking elements comprises a single frame plate having a frame opening with an opening cross-section smaller than said flange cross-section and larger than said base cross-section, so that said cleat can be inserted into said frame opening; and said movable locking elements comprises a lever or a slide movable in directions parallel to said top surface of the ski, between said outer surface of the boot and said flange against said base.

The invention is defined by the enclosed independent claims. Some preferable embodiments of the invention are disclosed in dependent claims and the following detailed description.

The invention provides important advantages over the prior art. With the present invention it is possible to provide a very short distance between the ski bottom and the user's foot. Also, the connection between the boot and the ski can be provided in an optimal location of the sole. For these reasons, the control of the ski is very accurate. The invention also allows easy fixing of the binding to a ski, and it also makes it possible to interface with other, older types of bindings.

BRIEF DESCRIPTION OF THE DRAWINGS

In FIG. 5A the binding is in an unlocked position and in FIG. 5B the binding is in a locked position, respectively.

FIG. 6A is an axonometric view in direction II of FIG. 2, and FIG. 6B is a side view in direction IV of FIG. 6A, and FIG. 6A additionally visualize the shape of the cleat of the fourth embodiment of the binding according to the invention as by dashed lines.

DETAILED DESCRIPTION OF THE PREFERRED EMBODIMENTS

Figure 1:
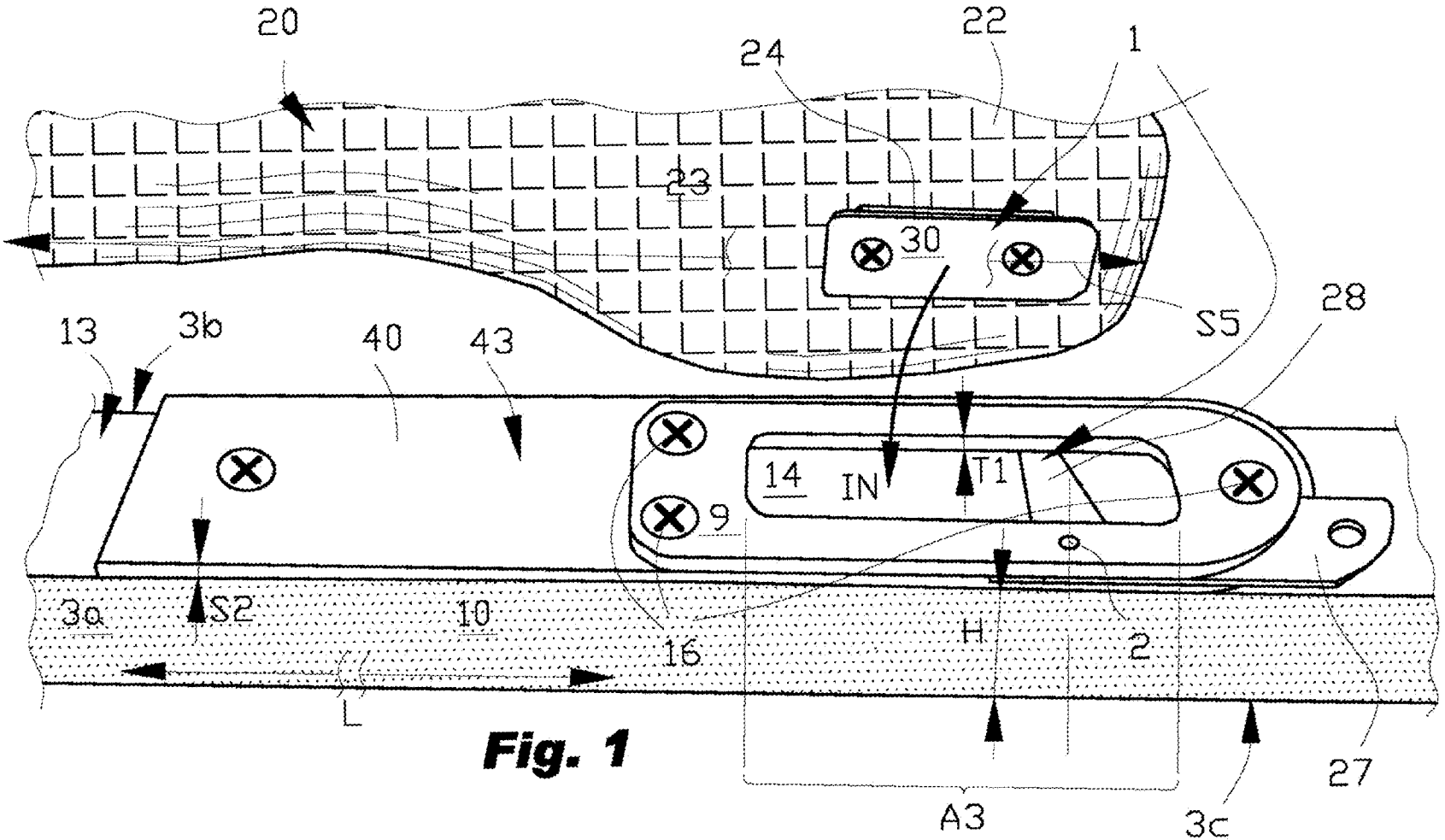
FIG. 1 is a perspective schematic view of a first embodiment of the binding according to the invention, for skating style skiing, illustrating contiguously a boot or shoe seen from outside of the sole together with a cross-country ski seen from its top surface side, both the boot and the ski with components for disengagebly fixing the boot into the ski.

It is disclosed a new construction concerns a binding 1 disengagebly fixing a boot 20 into a cross-country ski 10. The cross-country ski 10 has a length direction L, sides 3*a*, 3*b* with a width W therebetween and a thickness H perpendicular to the length and width. Further the ski 10 comprises a top surface 13 extending in directions of the length and the width, and of course a bottom surface 3*c*, which is intended to contact with the snow, which bottom surface can be of any type, and hence is not described in this text. The skiing shoe or boot 20 has a foot covering section, not shown in the drawings, and a sole 22 with a boot length direction S5 and an outer surface 23, in fact ground/floor etc. contacting surface 23, adapted to be positioned towards the top surface 13 of the ski. Basically the boot/shoe can be of any type suitable for skiing. In general the binding 1 has rigid connection components attached to the sole 21, as well as stationary locking elements receiving the mentioned rigid connection elements, and further movable locking elements disengagebly fastening the mentioned rigid connection components, which are attached on the boot, against the stationary locking elements. Both the stationary locking elements and the movable locking elements are attached to the ski 10.

According to the invention the rigid connection components are a single cleat 30 comprising a flange 31 that is at a lock distance S1 from the outer surface 23 of the sole 22, and a base 24 extending from the flange 31 thereof towards the outer surface 23 of the sole. The base 24 has a smaller base cross-section A2 than the flange cross-section A1 of the flange 31 in question. Accordingly, the flange is at the lock distance S1 from the outer surface 23 of the sole 2.

Figures 2, 3, 4:
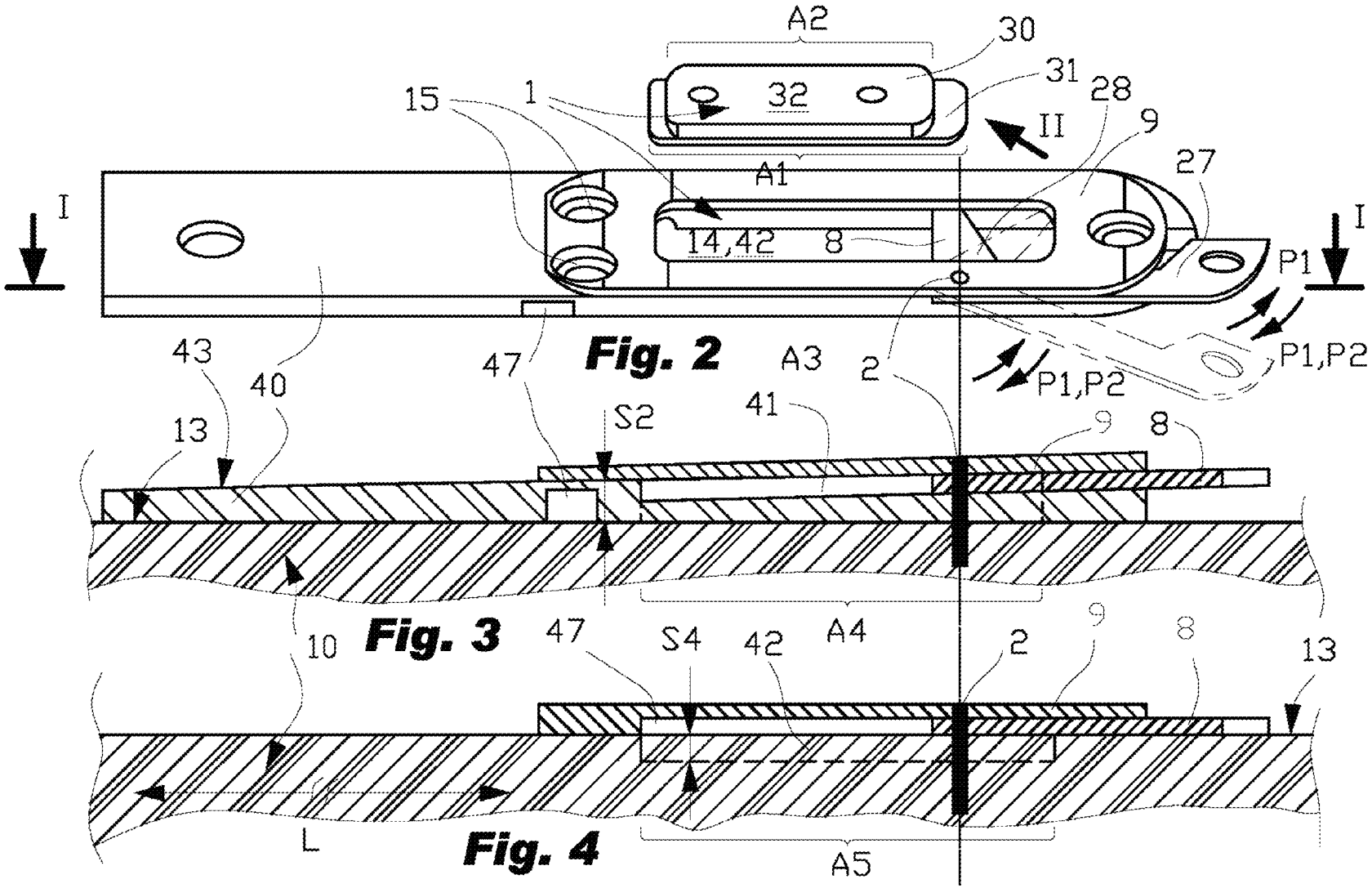
FIG. 2 shows the cross-country ski according to the first embodiment substantially in the same view as in FIG. 1 but more in detail with stationary locking elements, and a cleat to be attached to the sole of the boot in a position in which it can be inserted into the stationary locking elements when forwarded down towards the ski.
FIG. 3 is a cross-sectional view of the stationary locking elements according to the first embodiment of the invention positioned on the ski using a separate support plate between the actual locking elements and the ski, but without the fastening elements, seen along the plane I-I of FIG. 2.
FIG. 4 is a cross-sectional view of the stationary locking elements according to a second embodiment of the invention, for skating style skiing, positioned directly on the ski without the special support plate, and analogously without the fastening elements, seen in the same view as FIG. 3.
Figure 6A:
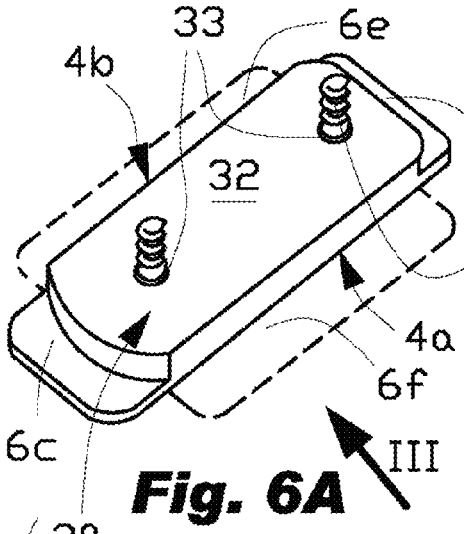
FIGS. 6A and 6B visualize the shape of the cleat of the first embodiment of the binding according to the invention, whereupon

Typically, but not necessarily, the single cleat 30 has planar and parallel side surfaces 4*a*, 4*b*, which are parallel with the boot length direction S5 and the length direction L of the ski, and also opposite flange sections 6*c*, 6*d* extending outside the base 24 between the side surfaces 4*a*, 4*b*, whereupon these flange sections 6*c*, 6*d* are in the boot length direction S5 and in the length direction L of the ski. This case is shown in FIGS. 1, 2 and 6A. This variant is also described in detail later in the text.

Alternatively, the typically or possibly parallel other side surfaces—not shown in the figures—can be perpendicular to the length direction L of the ski and perpendicular to the boot length direction S5, whereupon the respective other opposite flange sections 6*c* and 6*d*, shown by dashed lines in FIG. 6A, extend in a direction perpendicular to the boot length direction S5 and to the length direction L of the ski. In this latter case the slide 7—described later in this text—have two parallel forks 56*a*, 56*b* extending in the length direction L of the ski for locking the cleat to the ski. Anyway, the frame opening 14 of the frame plate 9 has naturally such dimensions, which respect to those of the flange section and the base of the cleat 30 in a way, which enable insertion of the cleat inside the single frame plate 9.

Figure 6B:
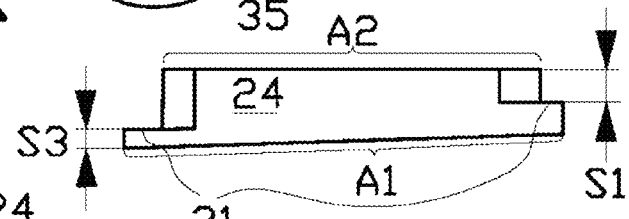
Figure 5A:
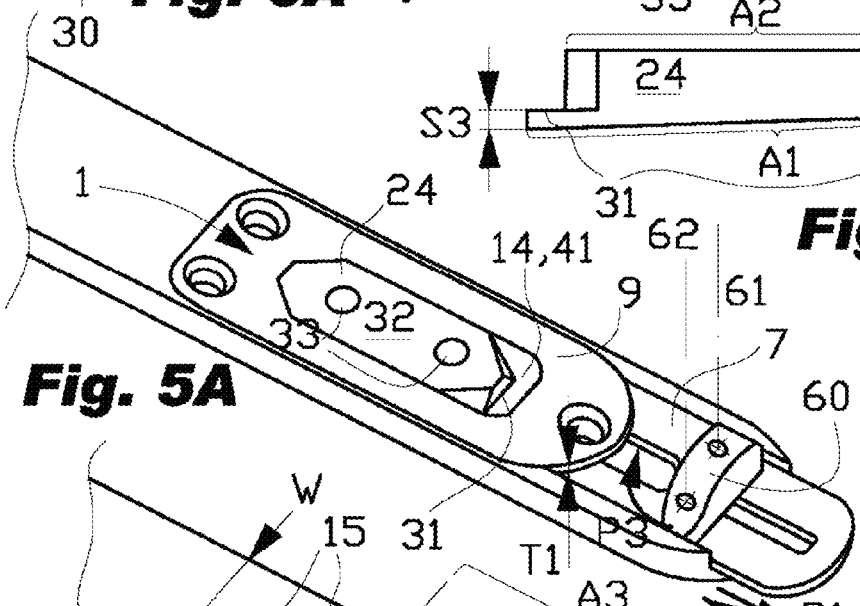
FIGS. 5A and 5B are perspective schematic views of a third embodiment of the binding according to the invention, also visualizing the rotation of the locking knob.
Figure 5B:
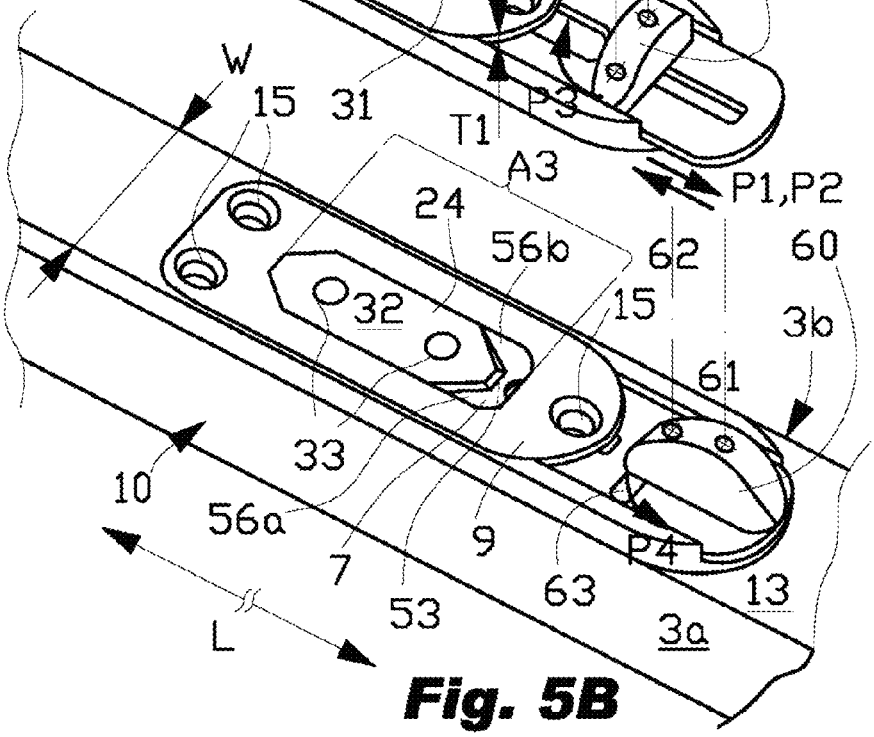
Figure 8:
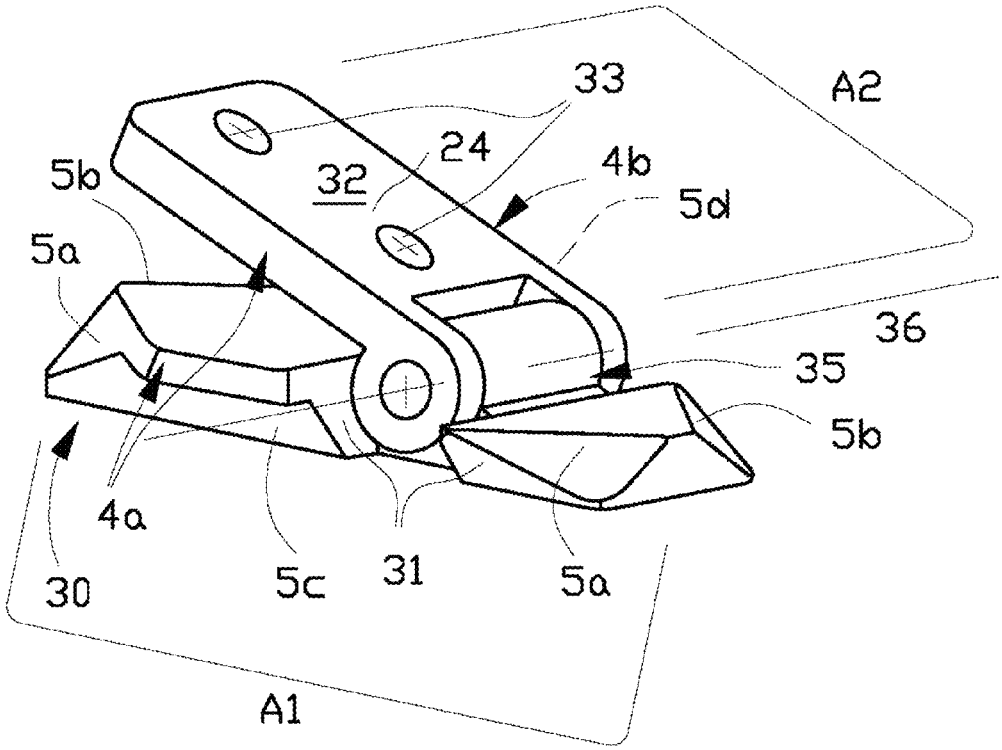
FIG. 8 visualizes the shape of the cleat of the sixth embodiment of the binding according to the invention, especially intended for classic style skiing, in the similar view as in FIGS. 5A-5B and 7. In this cleat the features of the cleats according to FIGS. 5A to 5B and FIG. 7 are combined.

Further in the single cleat, the transition from the base 24 with smaller base cross-sectional area A2 to the flange 31 with larger flange cross-section A1 can be attained by an abrupt step as shown in FIGS. 2, 6A and 6B—exhibiting a clearly limited base and a flange, or by an even or gradual transformation as shown in FIGS. 5A, 5B and 8—exhibiting substantial chamfers or bevels 5*a*, 5*b* and 5*c*, 5*d* (bevel 5*d*, not visible in FIG. 8, is opposite to the visible bevel 5*c*) between the opposite top and bottom surface and along the sides of the cleat 30. These bevels are e.g. for avoiding effects of snow. The described rigid cleat is practical in skies for skating style.

Further, the base 24 of the cleat 30 has a contact surface 32 directed away from the flange 31 and adapted to seat against the outer surface 23 of the sole 21. And also, the cleat 30 comprises first holes 33 for first fastening elements 34, with which fastening elements the cleat 30 is fixed to the sole 22.

The fastening elements can be screws, for example. It is also possible that the cleat is fixed to the sole by embedding the cleat partly inside the sole. In this case, the cleat may have a form which facilitates the attachment in side the sole.

The cleat is fixed to the sole in such a position, where—in the first and second embodiment—the side surfaces 4*a*, 4*b* and the opposite flange sections 6*c*, 6*d* extend at the boot length S5, or—in the fourth embodiment—the side surfaces and the opposite flange sections 6*e*, 6*f* extend perpendicular to the boot length S5, respectively. Accordingly, either the side surfaces and the opposite flange sections extend parallel with the ski length direction L, or alternatively the side surfaces and the opposite flange sections extend in directions perpendicular to the ski length direction L. Preferably the length direction L of the ski is substantially parallel with the boot length direction S5, but it shall be noted, that there can be a small or moderate angle between the ski length direction L and the boot length S5.

Figure 9:
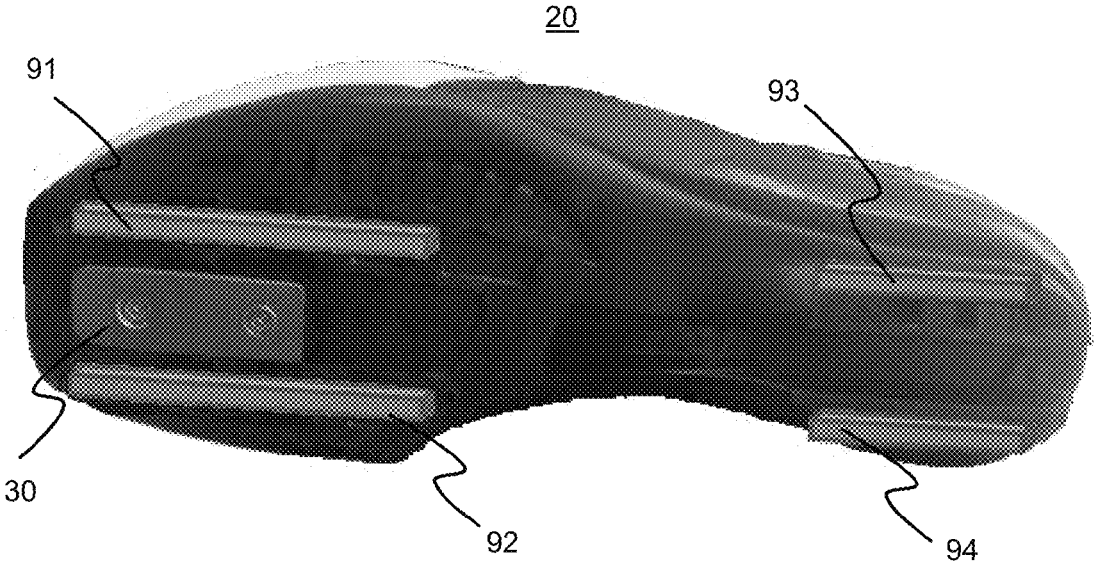
FIG. 9 illustrates a boot sole with risers according to an embodiment of the invention.

In one embodiment of the invention the sole of the boot has protrusions or "risers" at the sides of the sole, extending from the bottom surface of the sole. An exemplary boot sole 30 with risers illustrated in FIG. 9. The can be front risers 91, 92 at the front part of the sole, and back risers 93, 94 at the back part of the sole in order to provide balance. These risers preferably have such a height that the risers carry the user against the ground when the boots are not on a ski, instead of the cleat 30. The risers thus preferably extend from the sole surface at least as much as the cleat. On the other hand, the risers are preferably so located on the sole that the ski is between the risers when the boot is attached to a ski. The risers thus follow the ski edge outside the ski. The risers thus make walking with the boots more comfortable, and the cleat is not damaged due to carrying the weight of the user while standing or walking without skis. The risers also serve to avoid snow and ice from gathering and attaching to the cleat. Still, the risers do not increase the distance between a ski and the foot of the user. The risers also give more torsion and hold especially in skiing downhill.

According to the invention the stationary locking elements in the binding comprises a single frame plate 9 with a frame thickness T1, which is smaller than the lock distance S1 of the cleat 30. This single frame plate 9 has a frame opening 14, which has an opening cross-section A3 larger than the base cross-section A2 of the cleat 30 and simultaneously larger than the flange cross-section Al of the cleat 30, so that the cleat 30 can be inserted in direction IN into and through the frame opening 14. Here the "cross-section" means cross-sectional dimensions, which are in alignment with each respective other dimension, i.e. each respective pair of dimensions are compared for determining whether cross-section is smaller or larger. The mentioned inserting happens by pressing the shoe/boot 20 downwards—typically with the foot inside the shoe/boot, whereupon the cleat 30 is pushed into and through the frame opening 14 of the frame plate 9.

The single frame plate 9 further comprises second holes 15 for second fastening elements 16, with which the frame plate 9 is fixed to the ski 10 on the top surface 13 side thereof in a position, which enable inserting the cleat 30 such that the boot length direction S5 is parallel with the length direction L of the ski 10. In the preferred embodiment this means that the side surfaces and opposite flange sections extend along the length L of the ski 10, or alternatively such that its side surfaces and opposite flange sections extend perpendicular to the length L of the ski 10.

The above described single frame plate 9 can be fixed directly to the ski 10 such that the frame plate is in contact with the top surface 13 of the ski, or alternatively the above described single frame plate 9 can be fixed to the ski 10 such that there is a support plate 40 between the frame plate and the top surface 13 of the ski. The support plate 40—when included in the binding 1—has a support thickness S2 bigger than the flange thickness S3 of the flange 31, whereupon the cleat when inserted is not against the ski. For this purpose to the support plate 40 also has a support opening 41, which has a support cross-section A4 that is larger than the flange cross-section A1. Accordingly, the possible support plate 40 is attached between the frame plate 9 and the top surface 13 of the ski 10. In the other alternative without a support plate the binding 1 further comprises a cavity 42 on the top surface 13 of the ski 1. This cavity 42 has a depth S4 bigger than a flange thickness S3 of the flange 31 and a cavity cross-section AS larger than the flange cross-section A1, whereupon the cleat when inserted is not against the internal sections of the ski. Hence the support opening 40 and the cavity 42 are for receiving the cleat deep enough, so that the outer surface 23 of the sole can be pressed against the upper surface 19 of the frame plate 9. This way the boot/shoe and the foot can be positioned as close to the ski 10 as possible.

Additionally, the support plate 40 or the frame plate 9 may have snow removal channel or channels 47, which extend from the support opening 41 of the support plate 40 or from the cavity 42 of the ski 10 to the outside of the binding 1. Closing the lever 8 or the slide 7 pushes possible superfluous snow away from around the cleat, so ensuring fixing the boot into the ski.

Further, according to the invention, the movable locking elements comprises a lever 8 or a slide 7 movable in closing and opening directions P1, P2, which can be linear movement directions—as shown in FIGS. 5A and 5B, or rotary movement directions—as shown in FIGS. 1 to 4. Moving directions P1 and P2 are anyway substantially parallel to the top surface 13 of the ski, whereupon possible deviations of a few degrees are allowable, as caused by a sphenoid support plate or a sphenoid frame plate—as visible in FIG. 3. Typically the closing and opening directions P1, P2 are parallel with the top surface 13 of the ski or parallel with upper surface 43 of the support plate.

The lever/slide moves between the outer surface 23 of the boot and the flange 31 on the base 24, when the boot/shoe is pressed against the ski with the cleat 30 in the frame opening 14 of the frame plate 9. The lever 8 or the slide 7 moves against the base 24 of the cleat between cleat's flange 31 and the frame plate 9 to attain the fixing of the boot 20 into the cross-country ski 10—this is the closing movement direction, and respectively away from contact with the base 24 for the disengagement of the boot 20—this is the opening movement direction. The lever 8 and the slide 7, whichever is present in the construction, is positioned between the frame plate 9 and the top surface 13 of the ski, or between the frame plate 9 and the support plate 40 respectively.

The lever 8 has an operated arm 27, which is used e.g. by hand or the like, and an acting arm 28, which becomes strained against the cleat when the lever 8 is rotated around an axis 2 being between the operated arm 27 and the acting arm 28, which axis 2 is substantially perpendicular to the top surface 13 of the ski 10. Preferably the operated arm 27 and the acting arm 28 has a common form of the letter L, whereupon the operated arm 27 is generally longer than the acting arm 28. This configuration enables high enough closing force between the acting arm 28 and the cleat 30 to push possible snow away and ensure reliable locking of the boot.

The slide 7 is movable linearly in the length L direction of the ski 10 as shown in FIGS. 5A and 5B. For this purpose the slide 7 has an end 53, which presses against the base 24 of the cleat 30 between the flange 31 and the sole 22 just like the acting arm 28 of the lever. Alternatively, the slide 7 can have two parallel forks 56*a*, 56*b* extending in the length direction L of the ski along those sides of the cleat 30 parallel with the length direction L and having the alternative flange sections 6*e* and 6*f*. Hence, in the latter case the cleat comprises two flange sections 6*e*, 6*f* extending perpendicular to the length direction L of the ski 10 as mentioned earlier in this text. In both embodiments the slide 7 can be operated by a twisting knob 60, which is rotatable around an axis line 61 perpendicular to the top surface 13 of the ski 10. The knob also has a downward directed spindle with an axis line 62, which spindle protrudes into a transversal groove 63 of the slide 7. Twisting the knob 60 in directions P3 and P4 makes the spindle with the axis line 62 to co-operate with the transversal groove 63 so that the slide moves longitudinally in directions P1, P2, as can be easily understood by using the information from the figures, too. Hence in all variants the turning movements cause closing-opening of the lever 8 and the slide 7.

Figure 7:
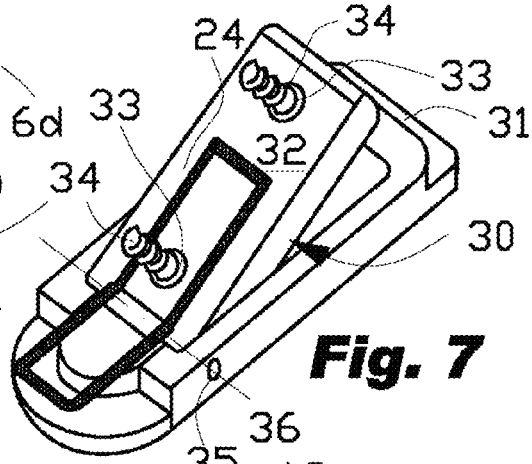
FIG. 7 visualizes the shape of the cleat of the fifth embodiment of the binding according to the invention, especially intended for classic style skiing, in the same view as in FIG. 6A.

For skating style skiing the cleat 30 is a single and stiff piece, which alternative is shown in FIGS. 1, 2, 5A-5B and 6A-6B. In this alternative the boot/shoe is kept tightly against the ski so that the heel of the boot/shoe remains substantially in contact with the ski. For classic style skiing the flange 31 and the base 24 of the cleat 30 are separate pieces, but connected by a swivel 35 to each other, whereupon the base is e.g. inside the flange which surrounds the base respectively. For classic style skiing the binding 1 accordingly comprises a swivel 35, which has an axis line 36 across the separate base 24 and separate flange 31 of the single cleat 30 in such a way that the axis line 36 is parallel with the width W of the ski 10, which alternative is shown in FIGS. 7 and 8. Now the first holes 33 for first fastening elements 34 are in the swiveling separate base 24. In this alternative for classic style skiing the heel of the boot/shoe is allowed to tilt upwards from the ski.

Figure 10:
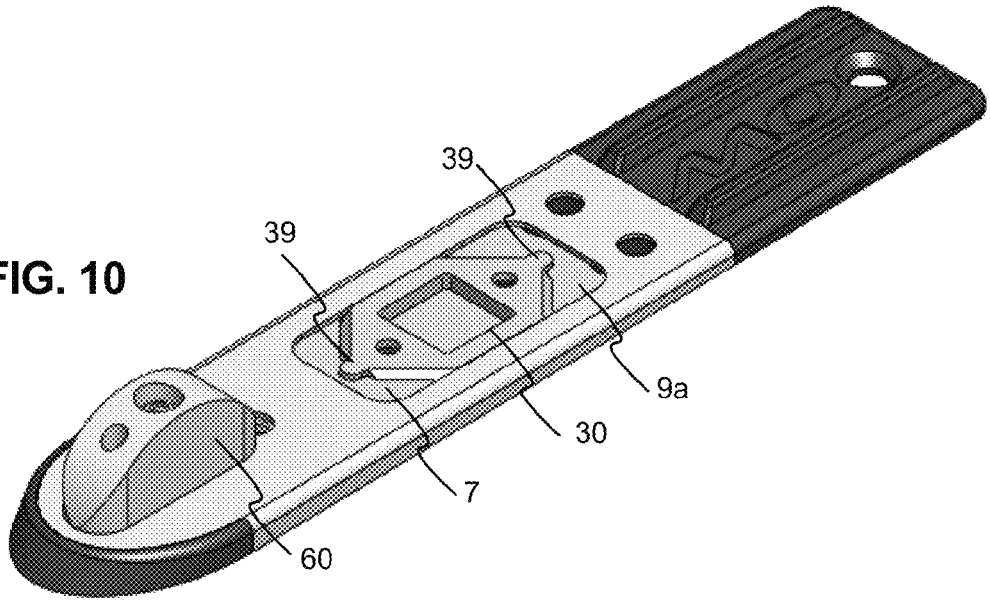
FIG. 10 illustrates a further embodiment of a binding.

FIG. 10 illustrates a further exemplary embodiment of a binding according to the invention. The Figure shows the cleat 30 of a boot inside the binding. The cleat has projections 39 as a formation by which it is possible to achieve a more accurate positioning of the cleat in the binding. The cleat is locked between parts 9*a* and 7 of the binding; slide 7 is movable by the knob 60 in order to lock/release the cleat.

Figure 11A:
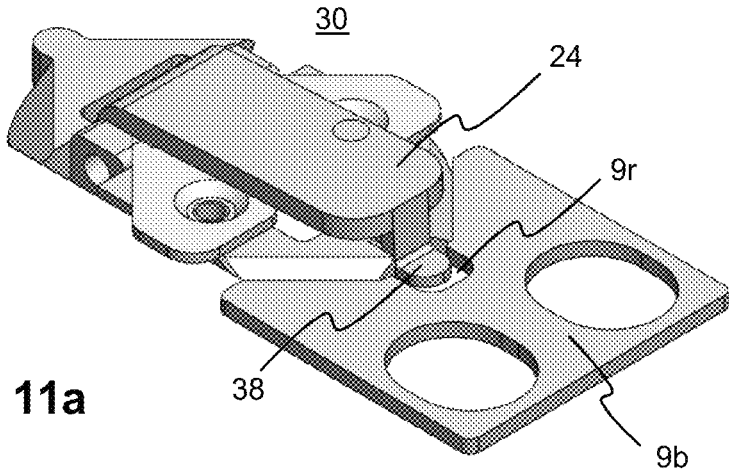
FIGS. 11*a* and 11*b* illustrate an arrangement where a same boot can be used for both skating style skiing and classic style skiing
Figure 11B:
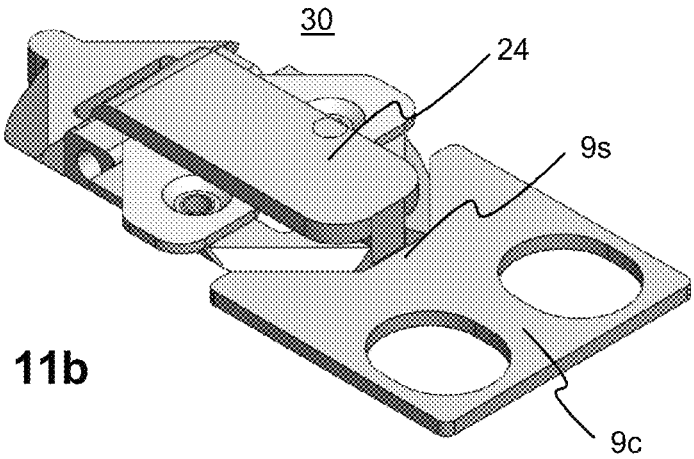

FIGS. 11*a* and 11*b* illustrate an exemplary arrangement where a same boot/cleat can be used with skating style skiing and classic style skiing. The cleat 30 has a swiveling base part 24 fixed to the boot. The base part 24 also has a projection 38 by which the base part can be locked from swiveling. A skating style ski has a binding where the rear locking part 9*b* has an opening 9*r* at the location of the projection 38. This way the base part 24 is able to tilt. In a classic style ski the binding has a different rear locking part 9*c* where the location of the projection 38 is closed 9*s*. The part 9*c* thus locks the base part 24 and prevents it from swiveling. This arrangement can be used in e.g. pursuit skiing, which includes both skating style and classic style skiing.

It is also possible to use automatic locking by providing an electric motor in the binding. In such an embodiment the motor can be arranged to rotate the knob 60 into a locking position when the cleat is inserted into the locking element of the ski binding. The rigid locking element may include electrical contacts which are shorted by the metal cleat when inserted into the locking element. Shorting the electrical circuit then activates the electric motor to move the movable locking parts into locking position. Alternatively, there may be an electromechanical switch that activates the motor. The circuit may also include a push button switch which activates the motor to unlock the movable locking parts when the user wants to release the locking. The electrical circuit also includes a battery and control electronics to provide these functions as understood by a person skilled in the art.

The present invention may also be adapted for using with other types of bindings. In such an embodiment the support plate may have a mechanical connection to a binding module of another binding system according to publication US 2007/0138765 A1, for example. The mechanical connection can be provided by specific grooves and/or protrusions in the sides of the support plate, for example. If a user already has boots for another binding system the user can still use skis with a binding according to the present invention by attaching a binding module in accordance with the other system to the ski binding of the present invention.

The invention has been explained above with reference to the aforementioned embodiments, and several advantages of the invention have been demonstrated. It is clear that the invention is not only restricted to these embodiments, but comprises all possible embodiments within the scope of the following patent claims.

The invention has been described with embodiments that relate to cross country skiing. However, the present invention can also be used in skis, boots and bindings for ski jumping and downhill skiing, for example.

The invention claimed is:

1. A binding disengagebly fixing a boot into a ski:

said ski having a length direction, sides with a width therebetween and a thickness (H) perpendicular to said length and width, as well as an top surface extending in directions of said length and width;

said boot having a foot covering section, and a sole with a boot length direction and an outer surface adapted to positioning towards said top surface of the ski;

whereupon said binding has:

rigid connection components attached to said sole, as well as stationary locking elements receiving said rigid connection elements, and movable locking elements disengagebly fastening said rigid connection components in the boot against said stationary locking elements, both said elements attached to said ski, characterized in that said rigid connection components are a cleat comprising a flange at a lock distance from said outer surface of the sole, and a base extending from said flange against said outer surface of the sole, whereupon said base has a smaller base cross-section than a flange cross-section of the same flange;

said stationary locking elements comprises a single frame plate having a frame opening with an opening cross-section larger than said base cross-section and larger than said flange cross-section, so that said cleat can be inserted into said frame opening; and said movable locking elements comprises a lever or a slide movable in directions parallel to said top surface of the ski, said lever/slide being between said outer surface of the boot and said flange on said base.

2. A binding according to claim 1, characterized in that said cleat has planar and parallel side surfaces and opposite flange sections extending outside said base between said side surfaces, and preferably side surfaces are parallel with said length direction, and said opposite flange sections extend in said length direction, OR said side surfaces are perpendicular to said length direction, and said opposite flange sections extend in directions perpendicular to said length direction.

3. A binding according to claim 1, characterized in that said base of the cleat has an contact surface directed away from said flange and adapted to seat against said outer surface of the sole.

4. A binding according to claim 2, characterized in that said cleat comprises first holes for first fastening elements, with which said cleat is fixed to said sole in a position, where said side surfaces and said opposite flange sections extend at said boot length.

5. A binding according to claim 1, characterized in that said single frame plate has a frame thickness smaller than said lock distance of the cleat.

6. A binding according to claim 1, characterized in that said single frame plate comprises second holes for second fastening elements, with which said frame plate is fixed to said ski on the top surface side thereof in a position, which enables inserting said cleat such that its side surfaces and said opposite flange sections extend along said length of the ski.

7. A binding according to claim 1, characterized in that said binding further comprises:

a support plate having a support thickness bigger than a flange thickness of said flange and having a support opening with a support cross-section larger than said flange cross-section, said support plate attached between said frame plate and said top surface of the ski; OR a cavity on said top surface of the ski, said cavity having a depth bigger than a flange thickness of said flange and a cavity cross-section larger than said flange cross-section.

8. A binding according to claim 1, characterized in that said lever or said slide move against said base of the cleat between cleat's flange and the frame plate to attain said fixing of the boot into the ski, and respectively away from contact with said base for said disengagement of the boot.

9. A binding according to claim 7, characterized in that said lever between said frame plate and said top surface or between said frame plate and said support plate respectively is movable rotatable around an axis perpendicular to said top surface of the ski, OR said slide between said frame plate and said top surface or between said frame plate and said support plate respectively is movable linearly in the length direction of the ski.

10. A binding according to claim 1, characterized in that said slide has:

an end in a longitudinal first opening, which end presses against said base of the cleat between said flange and the sole; or two parallel forks extending in the length direction of the ski along those sides of the cleat parallel with said length direction and away therefrom, whereupon said cleat comprises two flange sections extending perpendicular to said length direction.

11. A binding according to claim 1, characterized in that for skating style skiing said cleat is a single and stiff piece.

12. A binding according to claim 1, characterized in that for classic style skiing:

said flange and said base of the cleat are separate pieces, whereupon said base is inside said flange which surrounds the base respectively;

said binding further comprises a swivel, which has an axis line across a separate base and a separate flange to be parallel with said width of the ski, and first holes for first fastening elements in said separate base.

13. A ski with binding structure for a boot, characterized in that the binding structure is in accordance with claim 1.

14. A ski boot with a binding structure for a ski, characterized in that the binding structure is in accordance with claim 1.

15. A ski boot according to claim 14, characterized in that the boot sole comprises risers (91-94) near to sides of the boot sole, which risers extend from the bottom surface of the boot sole to carry weight of the user when standing on ground without skis, and the lateral distance between the risers is preferably equal or higher than the width of a ski at the area of the binding, whereby the ski is between the risers when the ski and boot are attached with binding.

* * * * *